US006966459B1

(12) United States Patent
Tseng

(10) Patent No.: US 6,966,459 B1
(45) Date of Patent: Nov. 22, 2005

(54) WATER INFILTRATION-PROOF STRUCTURE

(75) Inventor: Kun-Lung Tseng, Taichung Hsien (TW)

(73) Assignee: Living Fountain Plastic Industrial Co., Ltd., Dali (TW)

( * ) Notice: Subject to any disclaimer, the term of this patent is extended or adjusted under 35 U.S.C. 154(b) by 142 days.

(21) Appl. No.: 10/407,770

(22) Filed: Apr. 7, 2003

(51) Int. Cl.[7] ..... B67B 5/00
(52) U.S. Cl. ..... 222/153.13; 222/321.7
(58) Field of Search ..... 222/153.13, 321.1, 222/321.7, 321.9

(56) References Cited

U.S. PATENT DOCUMENTS 5,549,223 A * 8/1996 Hori ..... 222/153.13
5,738,250 A * 4/1998 Gillingham et al. ... 222/153.13
5,806,721 A * 9/1998 Tada ..... 222/153.13
6,308,865 B1 * 10/2001 Lin ..... 222/153.13
6,357,629 B1 * 3/2002 Ding ..... 222/153.13
6,604,656 B1 * 8/2003 Tseng ..... 222/153.13

* cited by examiner

*Primary Examiner*—Eric Keasel
(74) *Attorney, Agent, or Firm*—Egbert Law Offices

(57) ABSTRACT

A water stopping and infiltration-proof structure for a lotion spray nozzle, which is accomplished by adopting a water-stopping flange that is integrated with the cover top and is expanded from the top of the straight shaft tube, together with female and mate threading that are moved outwards along with the spray nozzle's bottom rim and the integrated cover's rim. This will enable the water-stopping flange to wipe off water drops on the piston shaft surface, and prevent water on the integrated cover top from infiltrating into the shaft tube.

1 Claim, 6 Drawing Sheets

WATER INFILTRATION-PROOF STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This creation is about a kind of water stopping and infiltration-proof structure for a lotion spray nozzle, specifically one which is primarily adopting a water-stopping flange that is integrated with the cover top and is expanded from the top of the straight shaft tube, together with female and male threading that are moving outwards along with the spray nozzle's bottom rim and the integrated cover rim, such will enable the water-stopping flange to wipe off water drops on the piston shaft surface, and prevent water on the integrated cover top from infiltrating into the shaft tube.

BACKGROUND OF THE INVENTION

Currently there are many liquid type products in the market, such as body lotion, shampoo, etc., all the containers of which are provided with a spray nozzle structure design (as shown in FIG. 5). The bottom of such spray nozzle 1 has a piston shaft 2, which is inserted into a cylinder 4 installed under the container cover 3, while the portion of the shaft that is jutting out from the cylinder 4 top through the container cover 3 is built into an integrated cover 5, the integrated cover 5 is provided with female threading 6, and the piston shaft 2's top section of the spray nozzle 1 is provided with a section of male threading 7 to match with that female threading 6 ring; the female and the male threading 6 and 7 are interlocked with each other holding the spray nozzle 1 at depressed and retracted condition, this will make displaying of products on market floor more convenient. However, such depressed and retracted structure of the spray nozzle is still considered not ideal during practical application, and has the following drawbacks.

By depressing the spray nozzle 1, the user draws out the liquid content in the container through the cylinder 4 by way of vacuum suction. Nevertheless, in this structure, the spray nozzle 1 remains in extending and protruding position under normal condition (as illustrated in FIG. 6), as a result, a water receptacle will be formed at the female threading 6 of the integrated cover 5, which receives water drops attached to the piston shaft 2 and the integrated cover 5 due to splashing, then the way of application by depressing the spray nozzle 1 will bring such water into the cylinder 4, consequently the phenomenon of diluting or deteriorating of the solution inside will arise.

Therefore, developing a structure for more ideal and more desirable water infiltration-proof structure design for the spray nozzle, in order to keep the liquid inside the cylinder 4 from being diluted, or even to wipe off the water drops on the surface, and prevent them from infiltrating, will certainly be a new type of product expected by the consumers, and should be a developing goal requiring efforts by the concerned industries.

BRIEF SUMMARY OF THE INVENTION

The female threading 11 and the mate threading 22 of the bottom rim of the spray nozzle 10 and the rim of the integrated cover 21 are moved outwards, so as to eliminate the water receptacle formed at the female threading in the traditional integrated cover.

A straight shaft tube 23 is installed at the center of the integrated cover 21 allowing the piston shaft 11 of the spray nozzle 10 to slide around it. This can preclude the possibility of letting water into the cylinder 30 thus resulting in dilution or deterioration.

A water-stopping flange at the center of the top surface of the integrated cover 21 is mainly used, so that the water-stopping flange 24 can directly wipe off the water drops attached on the surface of the piston shaft 21.

At the same time, the water-stopping flange 24 at the center of the top surface of the integrated cover 21 is used to prevent the water drops attached on the top surface of the integrated cover 21 from infiltrating into the shaft tube 23.

DETAILED DESCRIPTION OF THE INVENTION

For the purpose of further familiarizing the target, characteristics and functions of this creation, detailed descriptions are hereby given.

Figure 1:
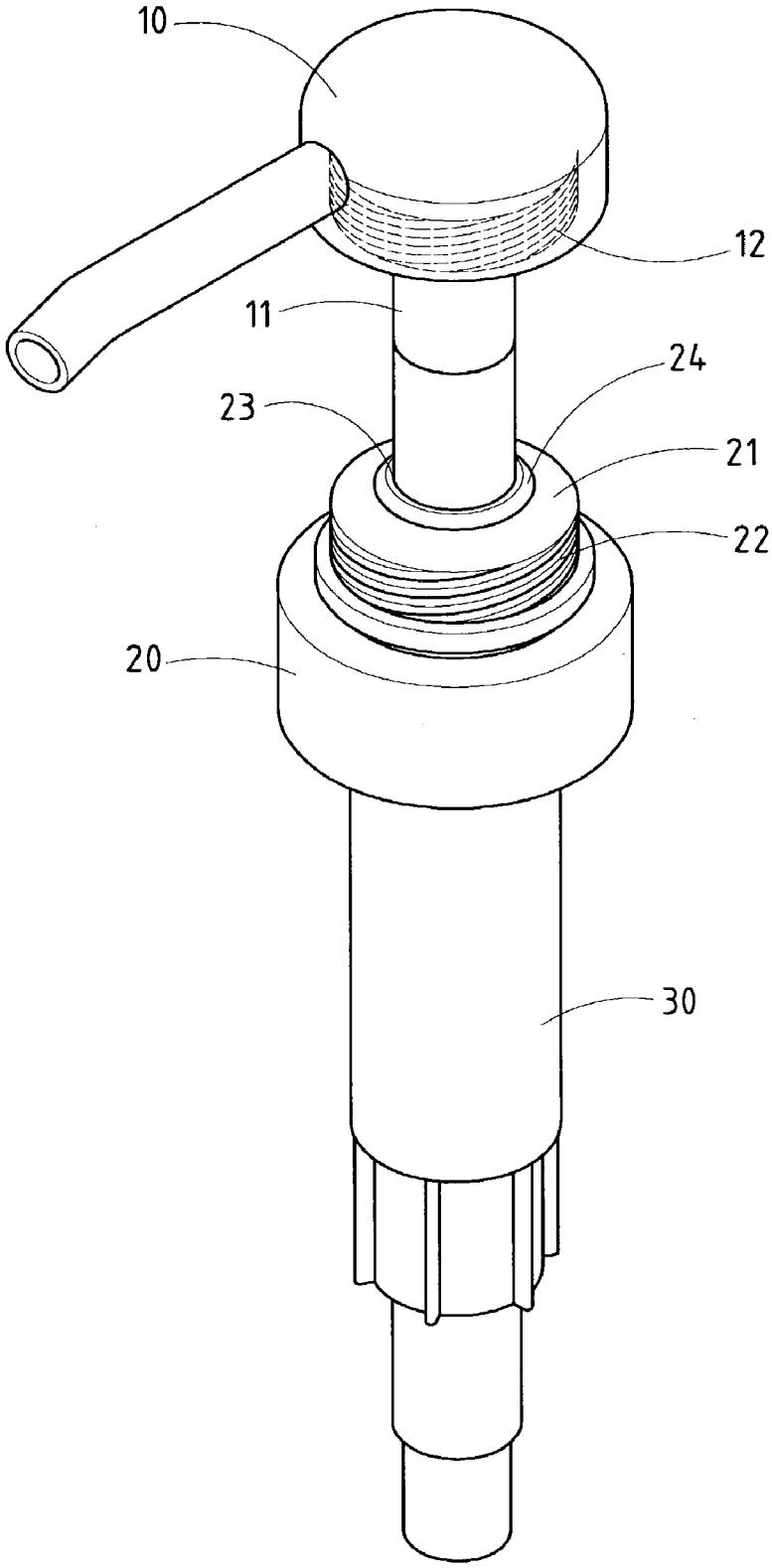
FIG. 1 is an upper perspective view of the lotion spray nozzle of this present invention.
Figure 2:
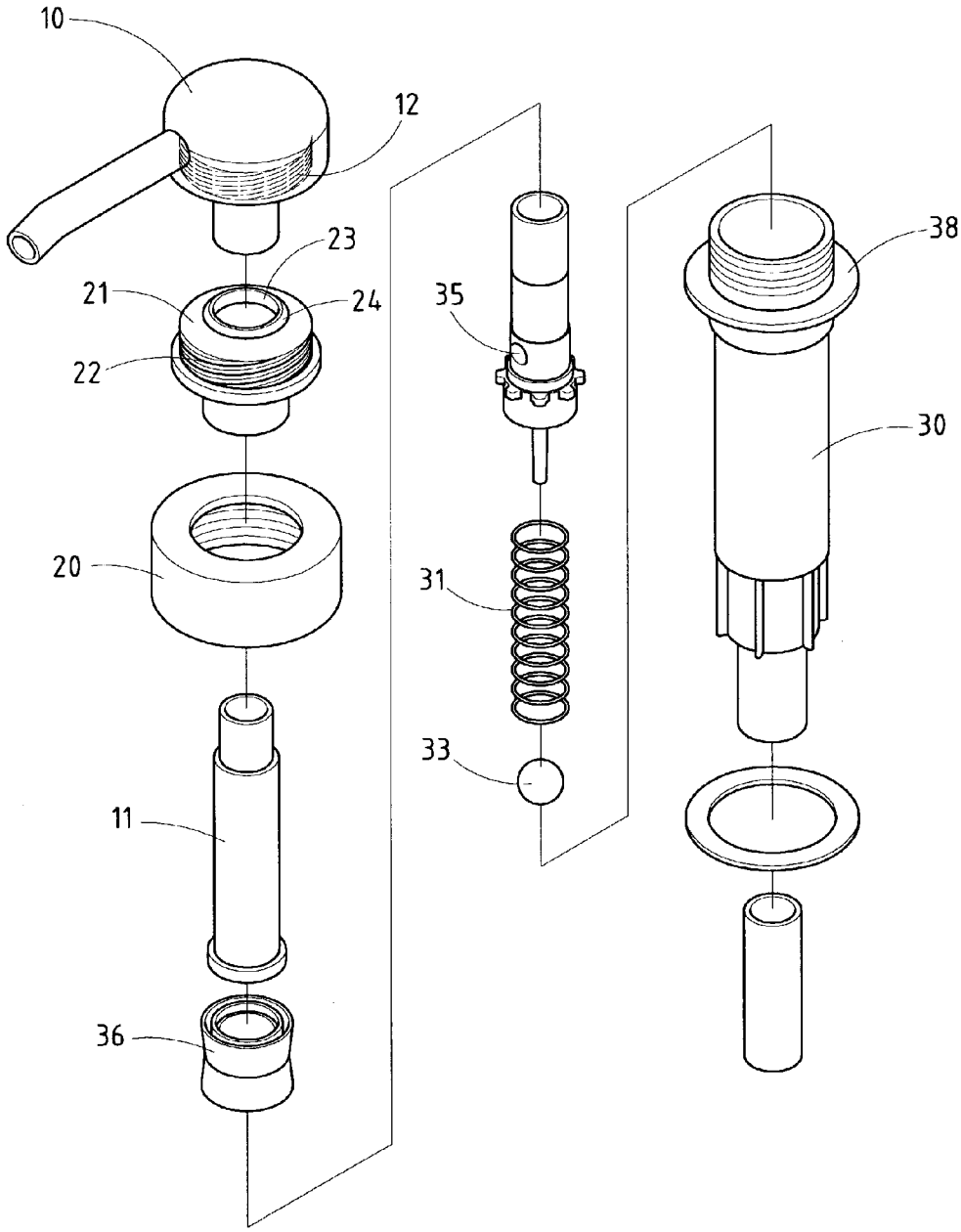
FIG. 2 is an exploded perspective view of the lotion spray nozzle of this present invention.
Figure 3:
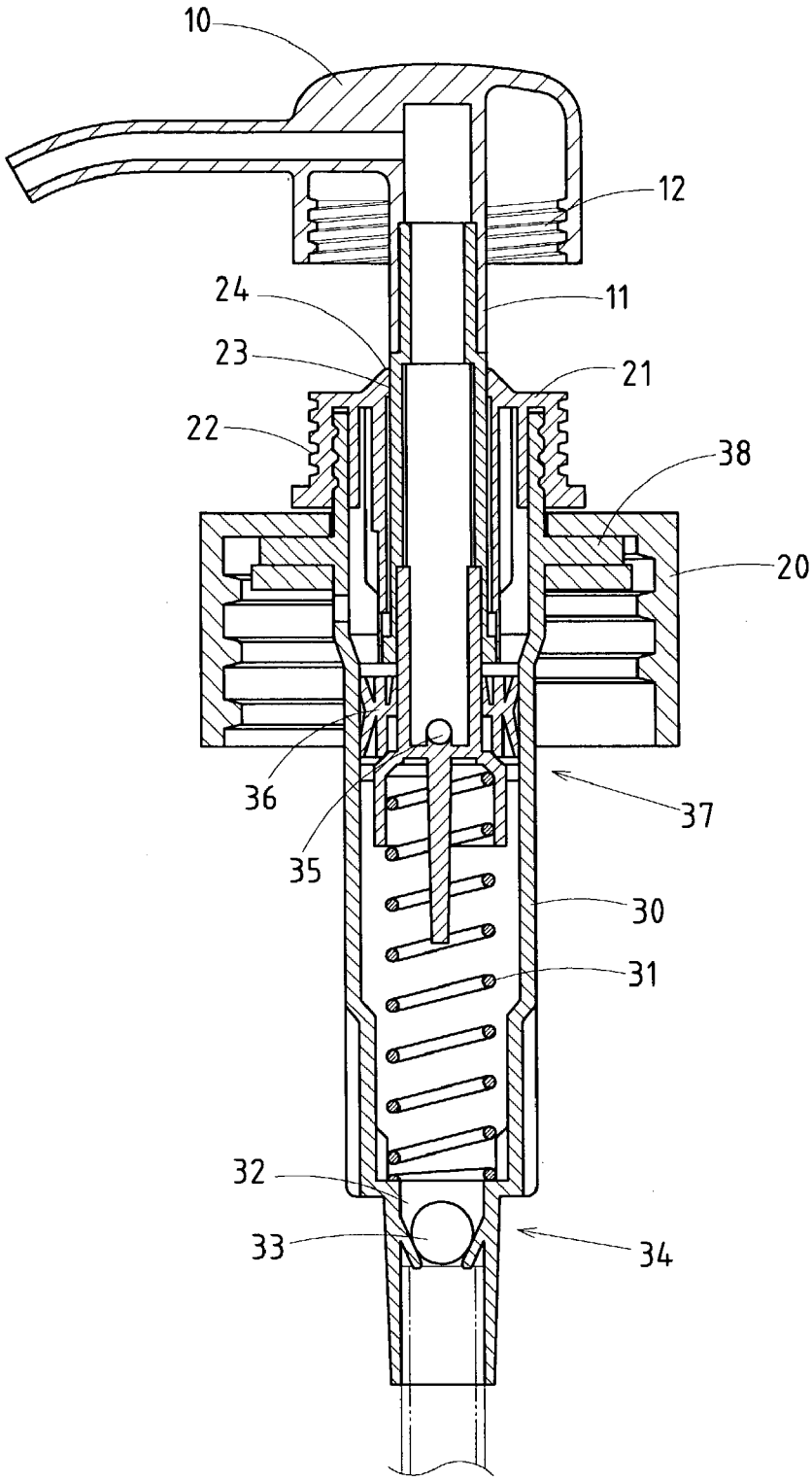
FIG. 3 is a cross-sectional view of the lotion spray nozzle of this present invention.
Figure 4:
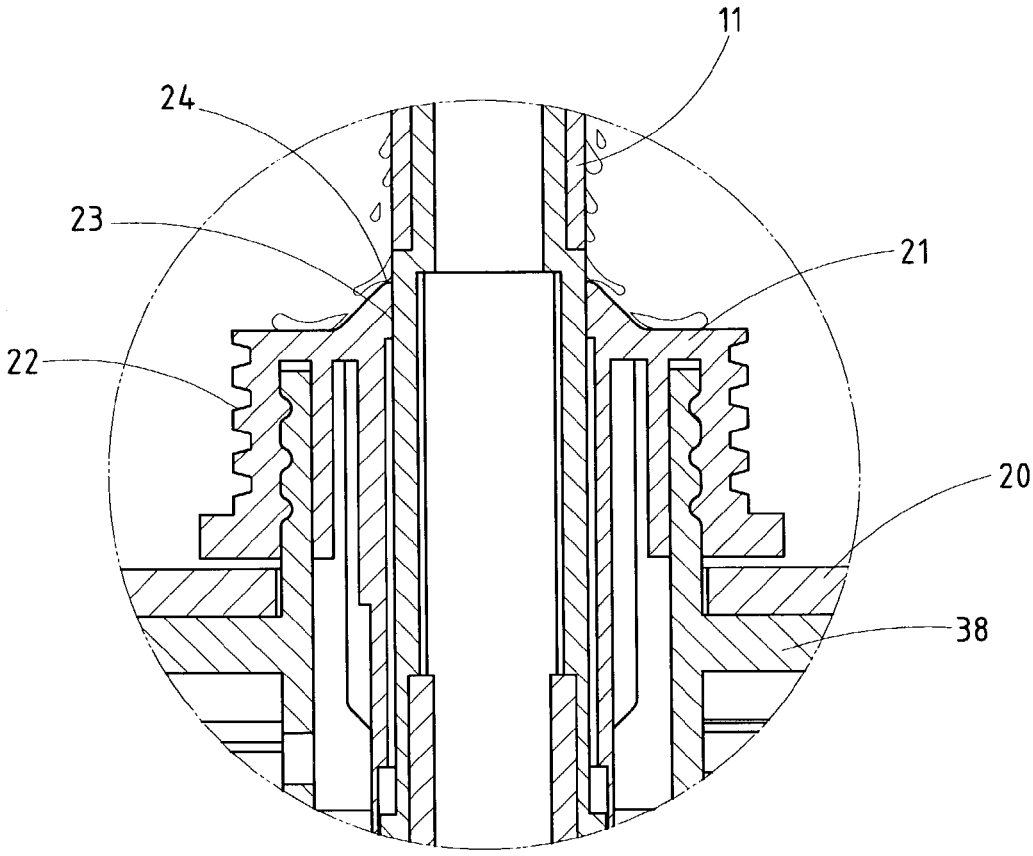
FIG. 4 is a cross-sectional view of a portion of the lotion spray nozzle of this present invention.
Figure 5:
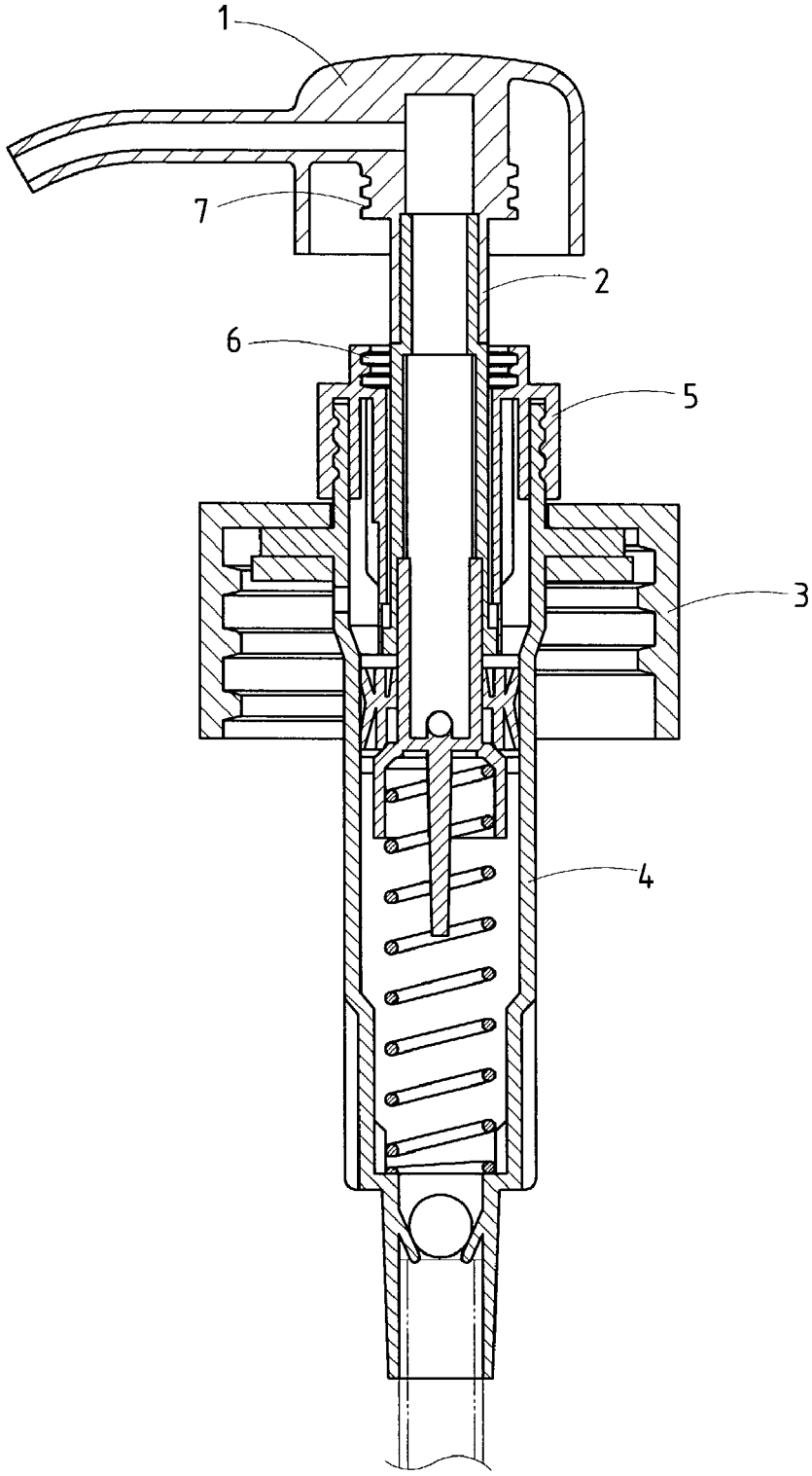
FIG.5 PRIOR ART
FIG. 5 is a cross-sectional view of the prior art lotion spray nozzle.
Figure 6:
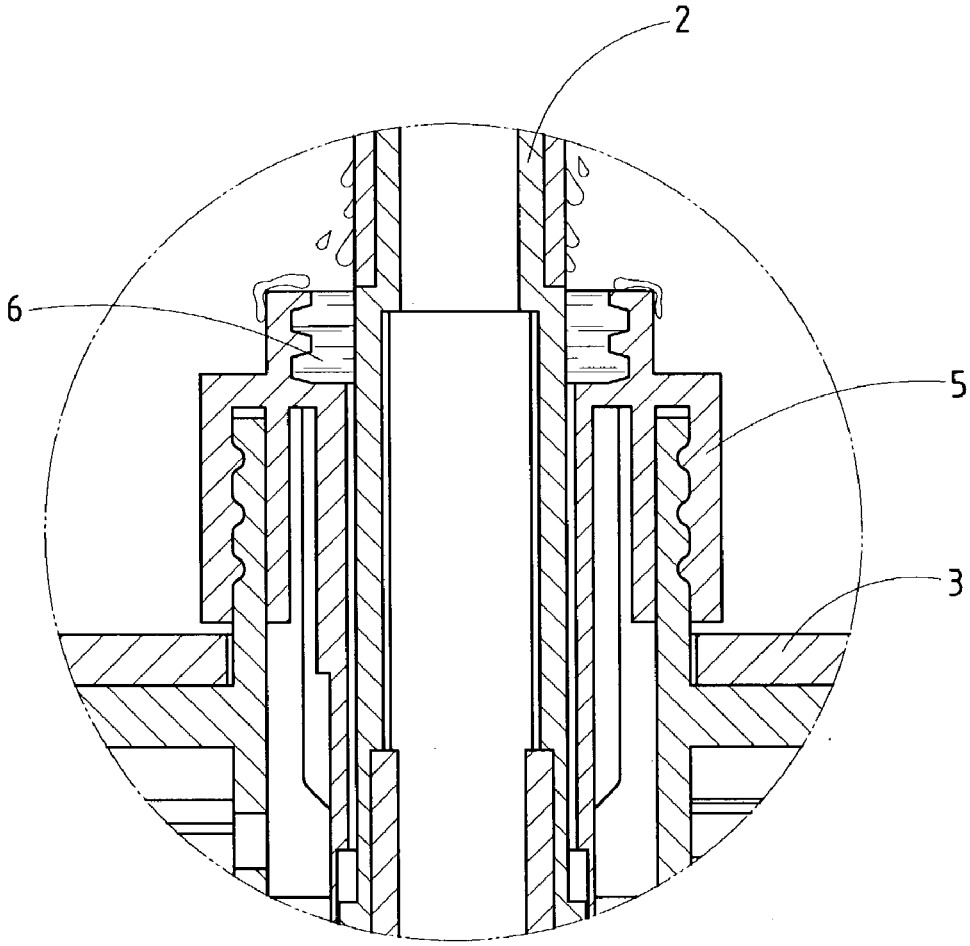
FIG.6 PRIOR ART
FIG. 6 is a partial cross-sectional view showing disadvantages in application of the prior art lotion spray nozzle.

First of all, please refer to illustrations in FIGS. 1, 2 and 3. This creation is to provide a kind of water stopping and infiltration-proof structure for lotion spray nozzle. The bottom of the spray nozzle 10 has a piston shaft 11, which is inserted into a cylinder 30 installed under the container cover 20, and a spring 31 is installed to brace the bottom of the piston shaft 11 from the inner bottom of the cylinder 30, moreover, a lower check device 34 is constructed on the inner bottom of the cylinder 30 by a lead-in slot 32 and a sphere 33, while an upper check device 37 is formed at the piston shaft 11 end by a flow guiding hole 35 and a floating piston ring; in addition, the container cover 20 is conjointly secured by a collar 38 at the upper section of the cylinder 30 and the integrated cover 21 assembled at the end. The main features lie in-female threading 12 and male threading 22 are respectively installed on the spray nozzle 10's bottom rim and the integrated cover 21's rim for mutual locking, a straight shaft tube 23 is provided at the center of the integrated cover 21 in order to allow the piston shaft 11 to slide around it; besides, a water-stopping flange 24 is installed at the center of the integrated cover 21's top surface, which is extending from the top end of the shaft tube 23 so that it can wipe off the water drops attached to the surface of the piston shaft 11, and can further prevent the water drops attached on the top surface of the integrated cover 21 from infiltrating into the shaft tube 23.

The top surface of the integrated cover 21 is shaped into a coned surface, along with the water-stopping flange at the center, which is extending from the top end of the shaft tube 23, they can hence wipe off the water drops attached to the surface of the piston shaft 11, and can further prevent the water drops attached on the top surface of the integrated cover 21 from infiltrating into the shaft tube 23.

In this creation, by way of adopting a water-stopping flange 24 that is installed on the top surface of the integrated cover 21 and is extending from the top end of the straight shaft tube 23, together with female and male threading 12 and 22 that are moved outwards along with the spray nozzle 10's bottom rim and the integrated cover 21's rim in order to eliminate the water receptacle formed at the female threading in a traditional integrated cover, and at the same time, the installation of a straight shaft tube 23 at the center of the integrated cover 21 allowing the piston shaft 11 of the spray nozzle 10 to slide around it, the possibility of letting water into the cylinder 30 thus resulting in dilution or deterioration can be effectively precluded. This is accomplished primarily by using the water-stopping flange 24 at the center of the integrated cover 21's top surface, so that the water-stopping flange 24 will wipe off the water drops attached to the surface of the piston shaft 11, and will effectively prevent the water drops on the top surface of the integrated cover 21 from infiltrating into the shaft tube 23.

I claim:

1. A lotion spray apparatus comprising:

a spray nozzle;

a piston shaft extending from a bottom of said spray nozzle;

a container cover;

a cylinder installed under said container cover, said piston shaft inserted into said cylinder;

a collar positioned at an upper section of said cylinder, said container cover secured by said collar;

an integrated cover assembled onto an upper end of said piston shaft, said integrated cover having a straight shaft tube extending centrally therethrough, said spray nozzle having a female threading formed therein, said integrated cover having a male threading thereon, said female threading being joined to said male threading so as to position said straight shaft tube so as to allow said piston shaft to slide therethrough; and a water-stopping flange means formed at a center of a top surface of said integrated cover and located at a top end of said shaft tube, said water-stopping flange means for preventing water drops on said top surface of said integrated cover from infiltrating into said shaft tube, said top surface of said integrated cover having a cone shape, said water-stopping flange means positioned centrally of said cone shape.

* * * * *